US005894701A

United States Patent [19]

Delorme

[11] Patent Number: 5,894,701

[45] Date of Patent: Apr. 20, 1999

[54] WOODEN MODULAR PANELING FOR INTERIOR DECORATION

[76] Inventor: Claude Delorme, 9141 Pierre Elliott Trudeau, St-Léonard, Québec, Canada, H1R 3V4

[21] Appl. No.: 08/910,667

[22] Filed: Aug. 13, 1997

[51] Int. Cl.[6] ..... E04F 13/10

[52] U.S. Cl. ..... 52/801.11; 52/506.01; 52/506.05; 52/287.1; 52/288.1; 52/311.2; 52/747.1; 52/745.2

[58] Field of Search ..... 52/586.1, 800.1, 52/801.1, 801.11, 801.12, 630, 311.2, 376, 384, 385, 506.01, 747.1, 506.05, 511, 512, 314, 287.1, 288.1; 249/47, 192

[56] References Cited

U.S. PATENT DOCUMENTS

| | | | |
|---|---|---|---|
| 232,153 | 9/1880 | Sweeney | 52/801.12 X |
| 335,342 | 2/1886 | Daugherty | 52/314 |
| 666,345 | 1/1901 | Goehst | 52/586.1 |
| 742,524 | 10/1903 | Miller | 52/506.05 |
| 1,069,345 | 8/1913 | Miller | 52/801.12 X |
| 1,212,005 | 1/1917 | Biberfeld | 52/314 |
| 1,343,468 | 6/1920 | Young | 52/801.11 X |
| 1,649,842 | 11/1927 | McBride | 52/506.05 X |
| 2,253,489 | 8/1941 | Smith | 52/288.1 |
| 4,575,982 | 3/1986 | Wenger | 52/512 X |
| 5,299,402 | 4/1994 | Lee | 52/384 X |
| 5,664,381 | 9/1997 | Betts | 52/801.11 X |

*Primary Examiner*—Robert Canfield
*Attorney, Agent, or Firm*—Swabey Ogilvy Renault

[57] ABSTRACT

A decorative modular wooden panel for applying onto a wall comprises a series of elongated wooden strips disposed in a side-by-side with a tongue-and-groove assembly and being pre-assembled together by way of a pair of removable connecting bars engaged in channels defined on the rear side of the panel and extending transversely across the strips. Staples are used to secure the connecting bars to the panel thereby retaining the strips together. The panel is secured to the wall with screws driven through opposed ends thereof and into the wall. Moldings extending across the opposed ends of the panel are secured thereto with finishing nails such as to conceal the screws and the upper ends of the strips. As no adhesives are used to secure the panel to the wall, the panel can be removed from the wall with minimal damage to the wall. The width of the panel may be reduced by removing the connecting bars and then removing a required number of strips with the connecting bars being re-assembled to the remaining strips after having been shortened. Elongated vertical corner elements are provided for connecting two panels located on each side of a corner of the wall.

13 Claims, 7 Drawing Sheets

WOODEN MODULAR PANELING FOR INTERIOR DECORATION

BACKGROUND OF THE INVENTION

1. Field of the Invention

The present invention relates to interior decorative finishing and, more particularly, to wooden paneling for application on walls.

2. Description of the Prior Art

U.S. Pat. No. 145,221 issued to Maitre on Dec. 2, 1873 discloses a panel module made up of parallel and similar panel sections engaged one to the other in a tongue-and-groove assembly and joined or held together with a cross key or with a wedge strip extending in a groove defined transversely on the rear surfaces of the panel sections. The panel module may be used in wainscoting.

U.S. Pat. No. 1,869,702 issued to MacChesney on Aug. 2, 1932 discloses a floor block made of a plurality of separate wooden strips longitudinally mating one with the other with tongue-and-groove joints and secured in this position with an elongated fastener which is engaged in transversal grooves defined in an aligned relationship on the back side of the wooden strips. The fastener which has a "U" shaped cross section and is made of metal has its edges partly embedded in the wooden strips.

U.S. Pat. No. 662,376 issued to Goehst on Nov. 20, 1900 discloses a hard-wood flooring panels for producing decorative borders on a floor and comprised of parallel boards engaged one to the other in a tongue-and-groove assembly and held together with a dovetail wedge engaged in a correspondingly shaped dovetail groove defined transversely on the rear surfaces of the boards. Bolts and nuts can be used to further secure the boards together.

U.S. Pat. No. 2,355,834 issued to Webb on Aug. 15, 1944 discloses springy metal splines that engage slots defined on facing sides of adjacent wooden blocks to retain the wooden blocks together in the production of floorings.

U.S. Pat. No. 1,946,646 issued to Storm on Feb. 13, 1934 discloses a floor made up of boards which are secured together with elongated metallic splines provided with ridges, the splines engaging grooves defined in the boards and being solidly retained therein by way of the ridges which enter the wood of the boards.

U.S. Pat. No. 369,216 issued to Temple on Aug. 30, 1887 discloses a board similar to the floor of aforementioned U.S. Pat. No. 1,869,702 although its elongated fastener has square corners and includes a serrated edge which engages the wood of the individual strips which form the board.

Also known in the art of wainscoting is the uses of thin individual wooden strips each having opposed longitudinal edges defining respectively a groove and a rib such that the strips are mounted one after the other to a wall by way of glue and nails, while mating at the level of their respective ribs, acting as tongues, and grooves. When it is desired to dismantle the wainscot, damage is made to the wall in view of the glue used to secure the wooden strips thereto. These strips are typically so thin that, in order to prevent warping, they must be secured basically throughout their length with glue.

Therefore, there is a need for a modular panel system in which each panel is made of a plurality of interconnected wooden strips and which easy to install, and ultimately to dismantle, and which is well suited to be installed by the homeowner, perhaps in the form of a kit.

SUMMARY OF THE INVENTION

It is therefore an aim of the present invention to provide a wooden modular panel adapted to be installed on a wall to provide a decorative effect.

It is also an aim of the present invention to provide a kit to easily install a wainscot on a wall.

It is a further aim of the present invention to provide a novel method for easily wainscoting a wall.

Therefore in accordance with the present invention, there is provided a decorative modular wooden panel for applying onto a wall, comprising a series of elongated wooden strips disposed in a side-by-side and abutting relationship and being pre-assembled together, said modular panel being adapted for being mounted to a wall.

Also in accordance with the present invention, there is provided a kit for applying a decorative wooden covering onto a wall, comprising at least one wooden paneling made up of a series of elongated wooden strips disposed in a side-by-side and abutting relationship and being assembled together with connecting means, and wall attachment means for securing said paneling to the wall.

Further in accordance with the present invention, there is provided a method of applying a wooden covering onto a wall, comprising the steps of:

a) providing a modular panel comprised of a series of elongated wooden strips disposed in a side-by-side and abutting relationship and being joined together; and b) securing said modular panel to the wall only with non-adhesive fastening means.

BRIEF DESCRIPTION OF THE DRAWINGS

Having thus generally described the nature of the invention, reference will now be made to the accompanying drawings, showing by way of illustration a preferred embodiment thereof, and in which:

FIG. 8 is a perspective view of a 45° corner element used with the modular paneling of FIGS. 1 to 3;

Figure 1:
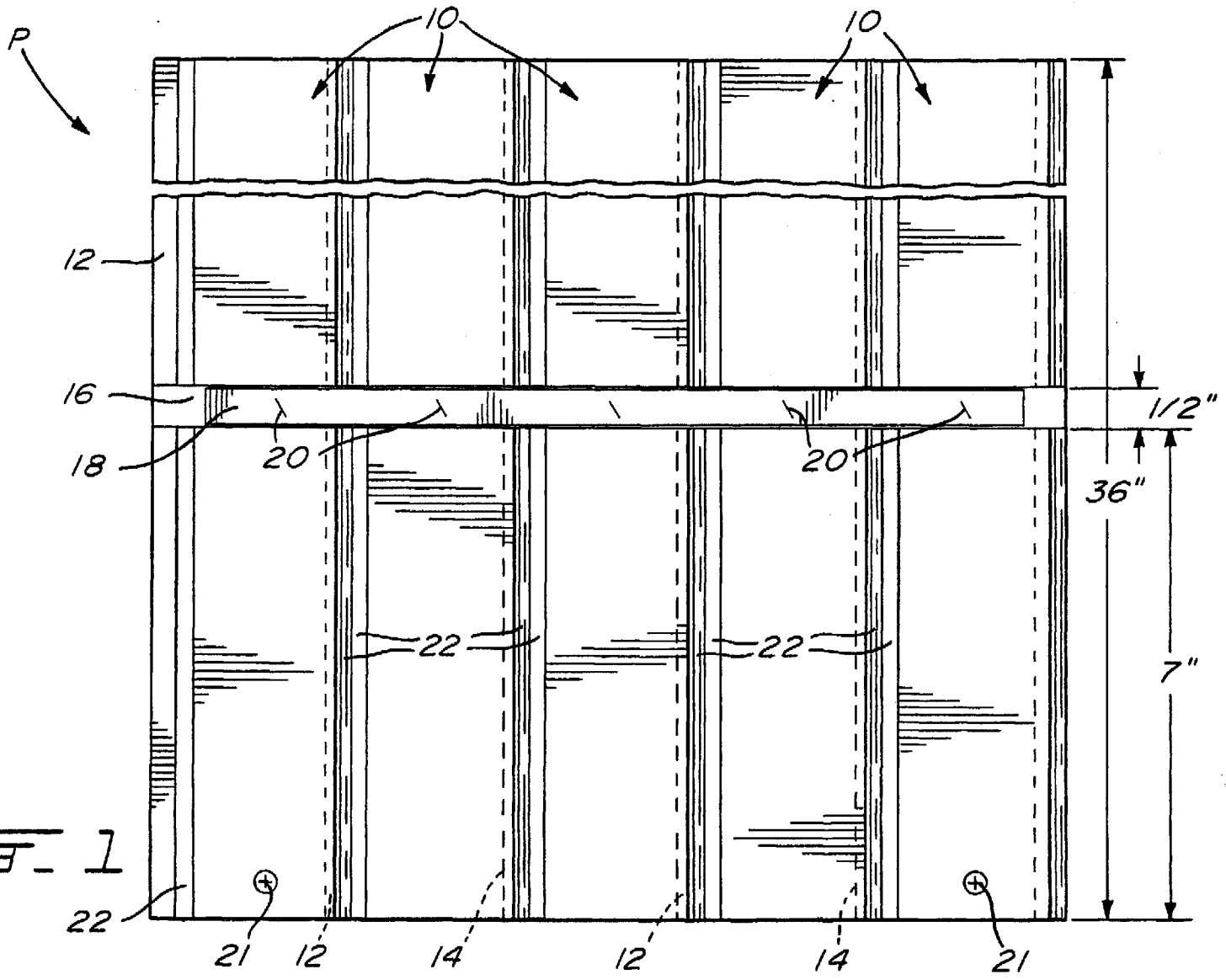
FIG. 1 is a schematic rear elevational representation of part of a wooden modular paneling in accordance with the present invention.
Figures 2, 3, 4, 5:
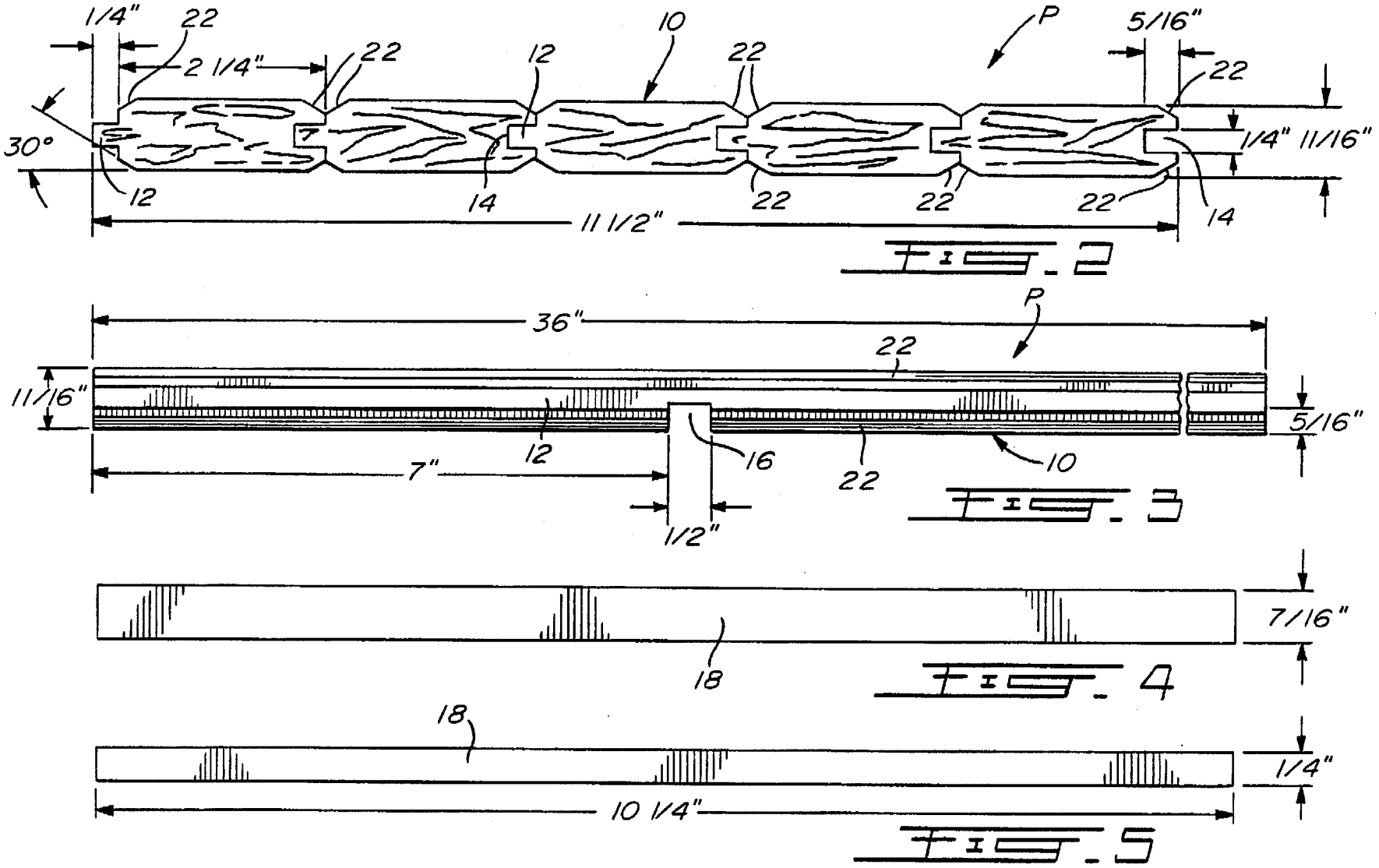
FIG. 2 is a top plan view of the modular panel of FIG. 1.
FIG. 3 is an end elevational view of part of the modular paneling of the present invention, but shown, as opposed to FIG. 1, without its lower connecting bar.
FIG. 4 is a detail elevational view of a connecting bar of the present modular paneling.
FIG. 5 is a detail plan view of the connector bar of FIG. 4.
Figure 11:
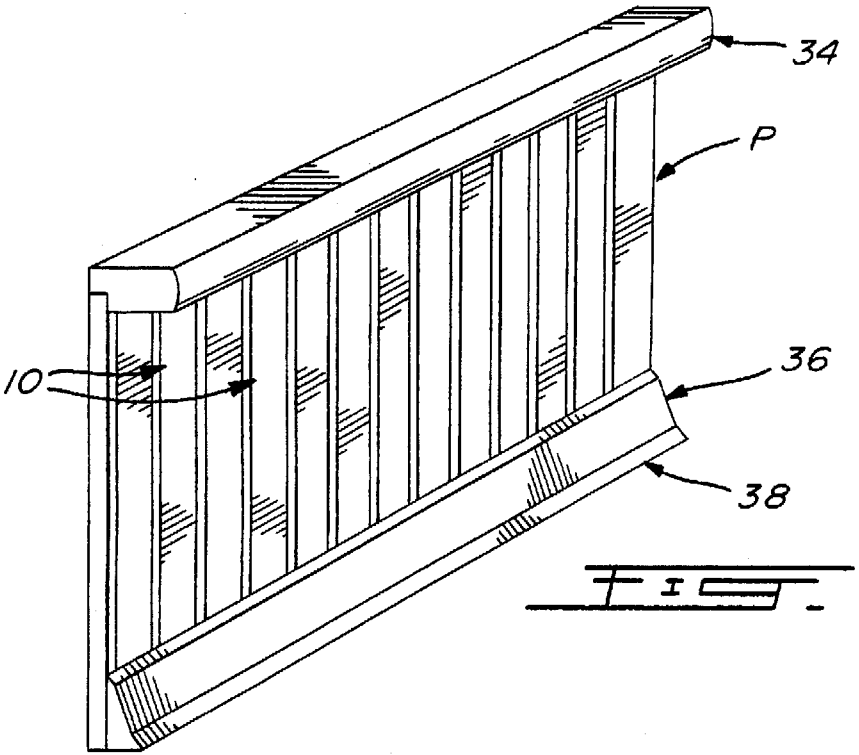
Figure 10:
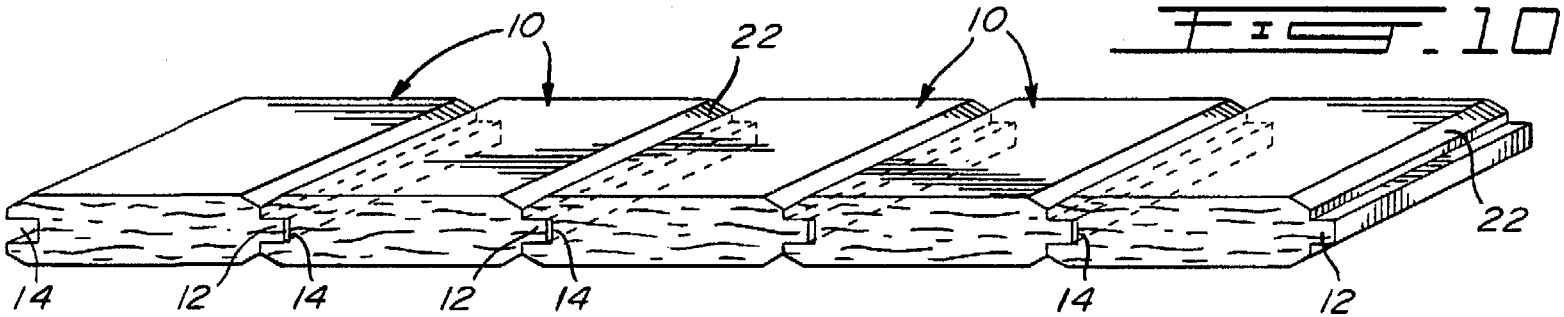
Figure 12:
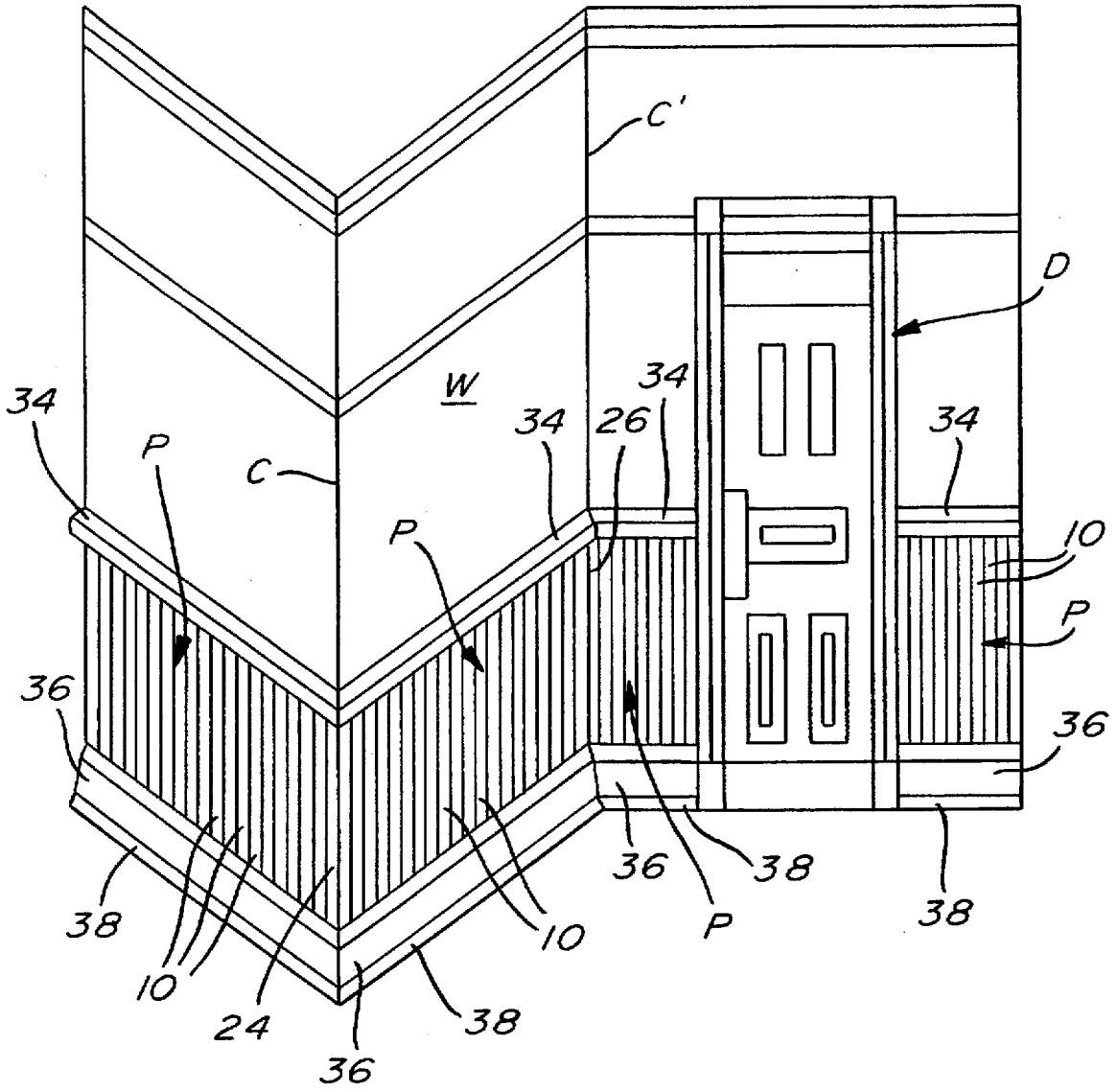

FIGS. *9a* to *9d* are perspective views of four different chair rails used with the modular paneling of FIGS. 1 to 3;

FIG. 10 is a perspective view of the paneling's wooden strips shown in a mating relationship;

FIG. 11 is a perspective view of a wainscot made with the modular paneling of the present invention and its chair rail and baseboard; and FIG. 12 is a schematic perspective view of an interior wall along which the present modular paneling, chair rail and baseboard have being installed.

DESCRIPTION OF THE PREFERRED EMBODIMENTS

FIG. 1 illustrates in a schematic partial rear elevational view a modular paneling P in accordance with the present invention which can be used, for instance, when wainscoting the lower 3 or 4 feet of a wall with wooden strips disposed side-by-side in a vertical and parallel relationship with FIG. 1 only showing a lower part of the paneling P.

The modular paneling of FIG. 1 comprises a series of wooden boards or strips 10 made, for instance, of cedar although various other wood materials may be obviously used, such as pine, maple, oak, etc. The strips 10 are preferably substantially thick in order to prevent warping, for instance between 0.5" and 0.75" in thickness including the illustrated thickness of 11/16" seen in FIG. 2.

As best seen in FIGS. 2 and 10, each strip 10 includes along opposed longitudinal edges thereof a rib or tongue 12 and a groove 14 such the strips 10 can be disposed in a parallel side-by-side mating relationship where the tongue 12 of a given strip 10 is received in the groove 14 of an adjacent strip, in a way well known in the art. Glue may be applied in the grooves 14 to hold the strips 10 of a same panel P together.

Additionally, upper and lower transversal, i.e. horizontal, channels 16 (only the lower channel 16 being shown in FIG. 1) are defined on the back side of the modular paneling P, these channels 16 being typically formed once the strips have been mated one with the other. As illustrated in FIG. 1, a connecting bar 18 is positioned in each channel 16, with details of the connecting bar 18 being shown in FIGS. 4 and 5. The connecting bars 18 are secure to the strips 10 with heavy duty staples 20 (see FIG. 1) with such staples being at least provided at both end strips 10 but preferably being provided for each strip 10. Therefore, the strips 10 are secured together by the common connecting bars 18 and the staples 20 and possibly also by glue previously used to attach the tongues 12 in the grooves 14.

In view of the thickness of the strips 10 and their interconnection with the bars 18, the modular panel P so produced is substantially rigid and not subject to warping. This allows for the modular panel P to be installed on a wall without using any glue as opposed to prior art techniques where glue was required along the length of each strip as the strips were applied, one after the other, onto the wall. Indeed, with the present modular paneling P, it is only required that screws (or nails but screws being preferred) be used to secure the paneling to the wall and this is achieved by driving at least one screw 21 through the paneling P near each of its upper and lower edges and into the wall (preferably into a stud located behind the wall's gypsum sheet) and, more particularly, two (2) screws 21 are used at each such edge, as seen in FIG. 1 for the lower edge of the paneling P.

The strips define for decorative purposes beveled edges 22.

Figures 6, 7:
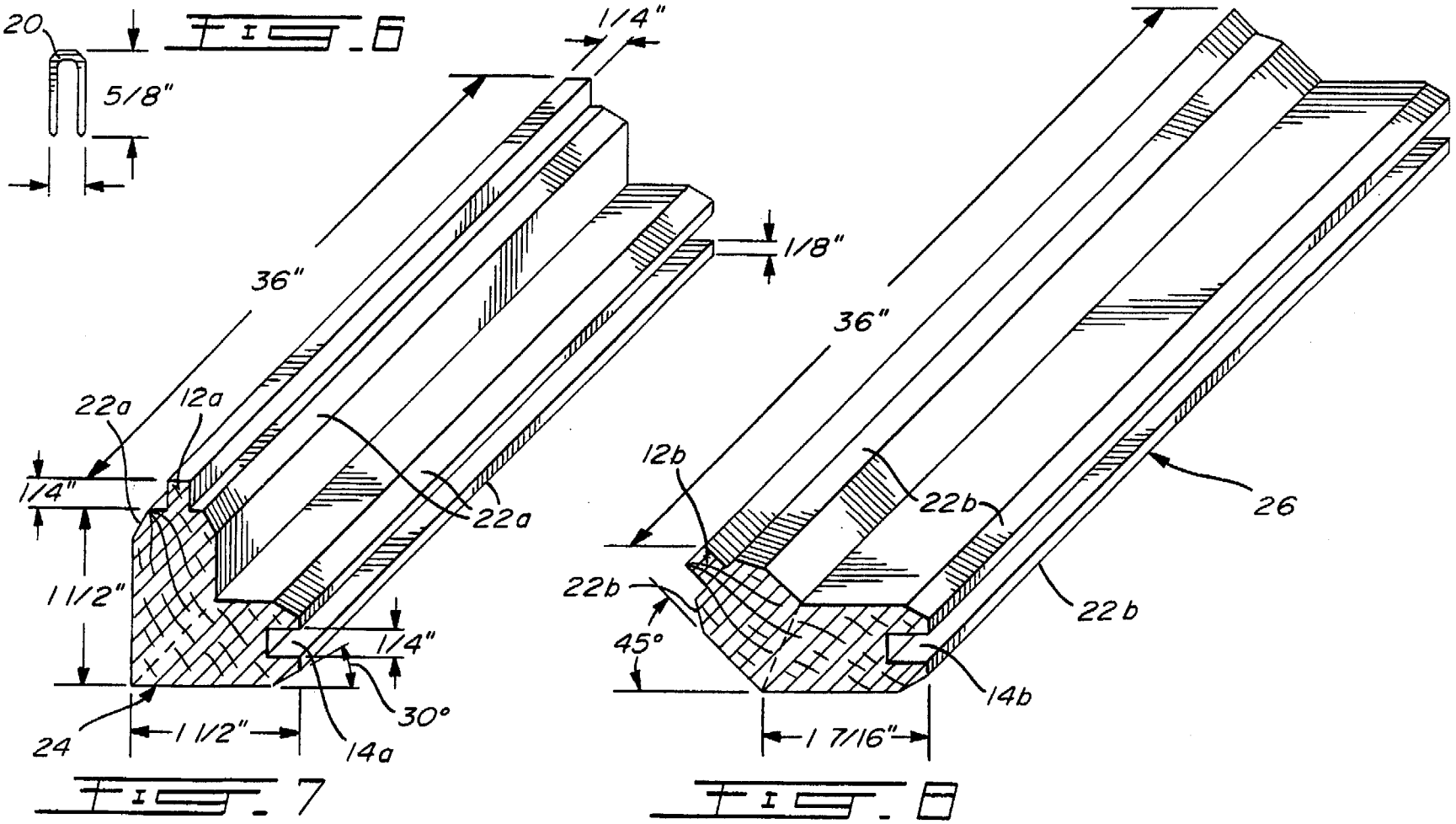
FIG. 6 is a detail view of a staple used in the modular paneling of the present invention.
FIG. 7 is a perspective view of a 90° corner element used with the modular paneling of FIGS. 1 to 3.
Figures 9A, 9B:
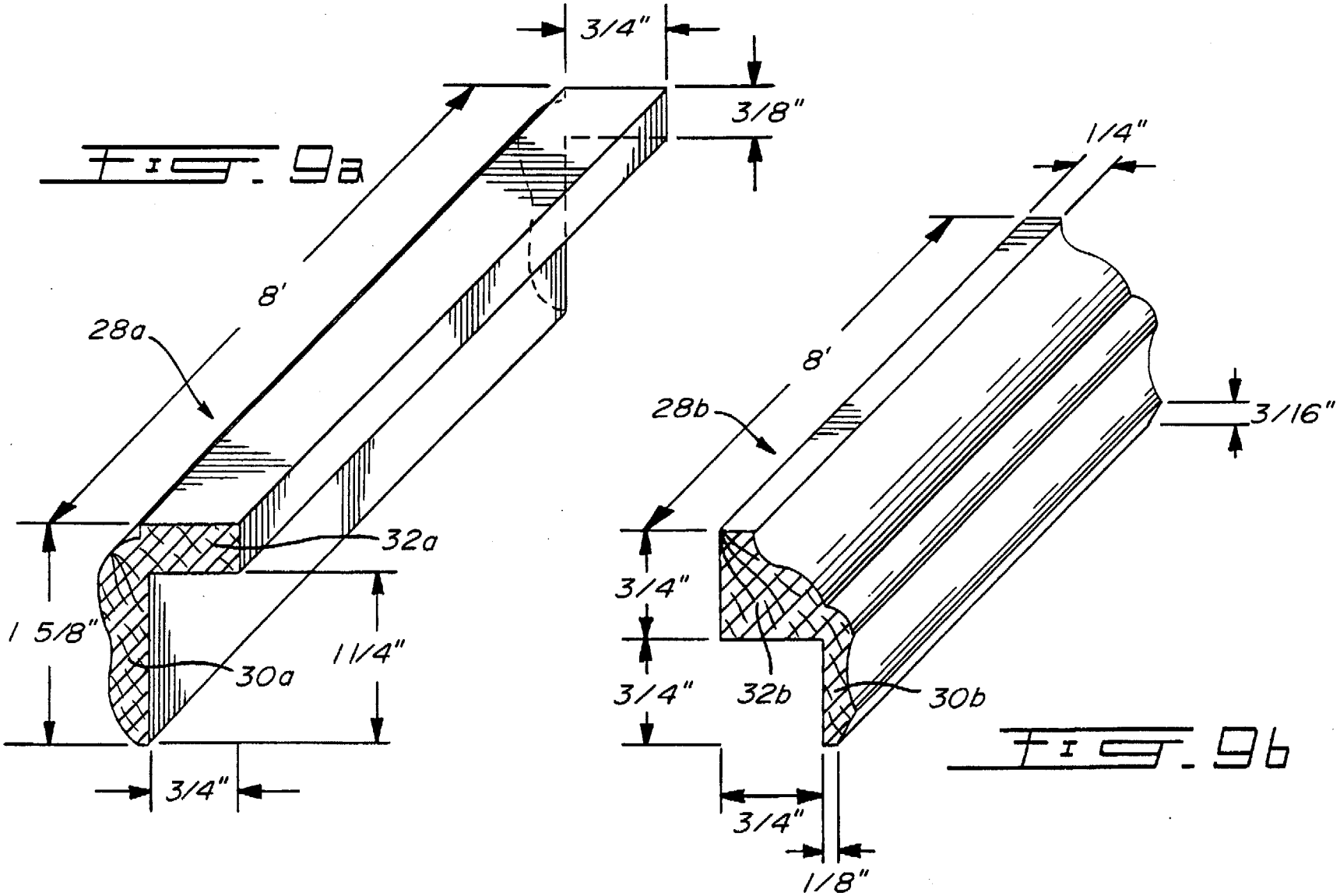
Figure 9D:
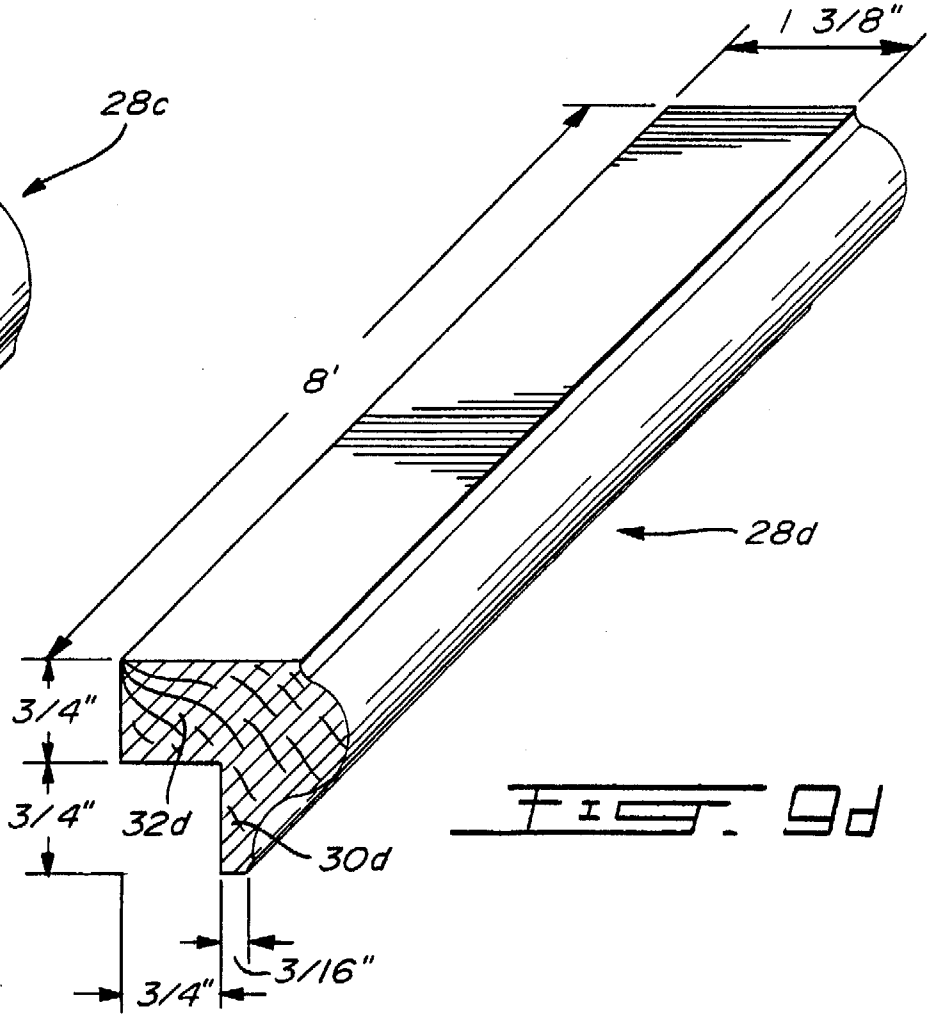
Figure 9C:
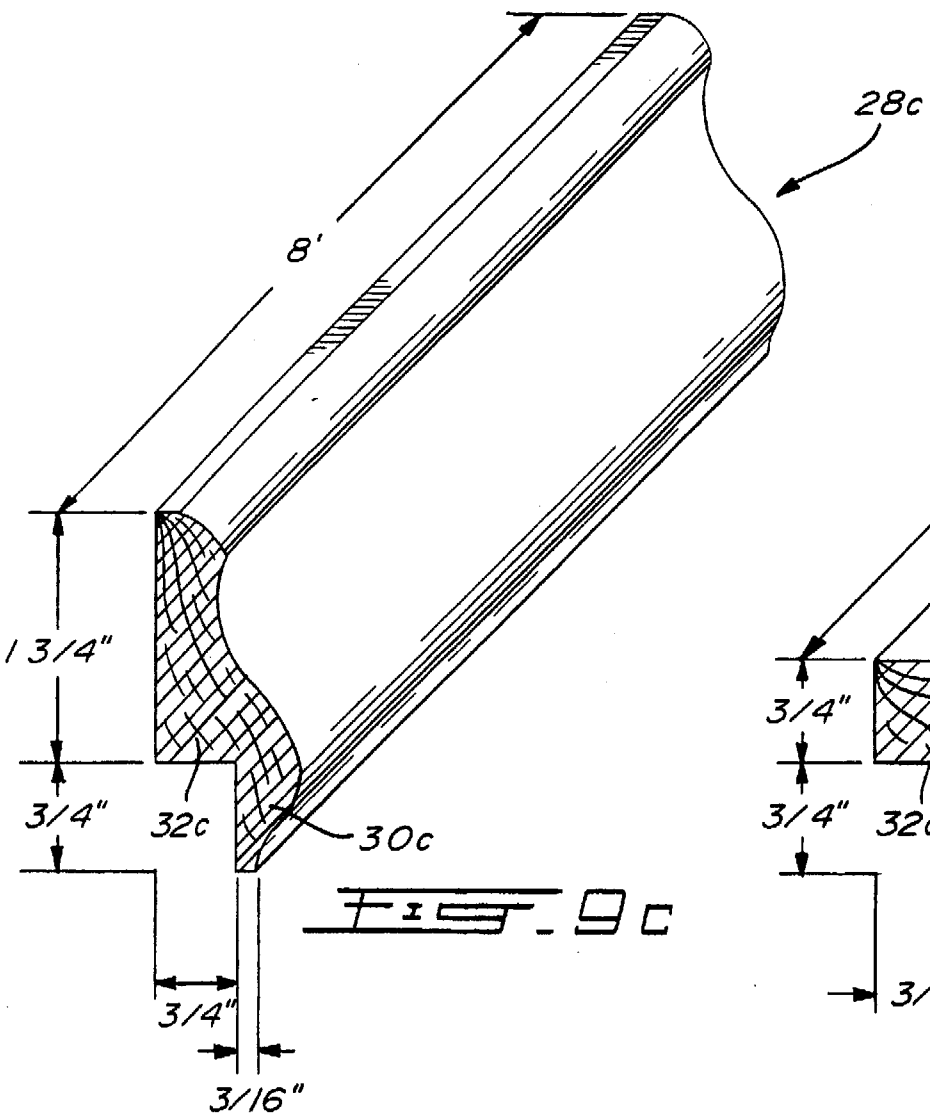

Accessories such as 90° and 45° corner elements 24 and 26 respectively (see FIGS. 7 and 8) are provided for wainscoting with the present modular paneling P through various types of corners defined by the wall. These corner elements 22 and 24 are cleanly finished on both sides such that they are reversible and may thus be used on outside corners of the wall as well as on inside corners thereof. Ideally, the corners 24 and/or 26 are installed before the modular panels P.

With the connecting bars 18, it is easy to fit the modular paneling at the ends of the wainscot or at wall corners by first removing the connecting bars 18, then removing a required number of strips 10 until a desired width of the paneling P is obtained and shortening by sawing the connecting bars to fit with the paneling's new width, and by finally re-installing with staples 20 the connecting bars into the channels 16. The customized paneling P may then be mounted to the wall with screws 21, as explained hereinabove.

Further accessories are provided, such as decorative chair rails and baseboards which are wooden moldings (e.g. made of pine) installed horizontally across the upper and lower edges respectively of the strips 10 by being glued thereto, although typically finishing nails are preferably used. FIGS. 9*a* to 9*d* illustrate various models 28*a* to 28*d* of such upper chair rails which each comprises a vertical section 30*a* to 30*d* for covering the screws 21 and a horizontal section 32*a* to 32*d* for covering the upper edges of the strips 10. The chair rails 28*a* to 28*d* may be secured to the paneling P by driving finishing nails through their horizontal sections 32*a* to 32*d* and into the upper end of the modular paneling, or even possibly through the vertical sections 30*a* to 30*d*.

The baseboards, although not herein shown, typically only each have a vertical section applied in front of the lower end of the paneling P and nailed thereon.

Typically the chair rails and the baseboards are provided on lengths of 8 feet and thus cover 4 to 6 modular panelings P (depending on each paneling's width).

If the wainscot must be removed, one only has to detach the chair rails and baseboards from the modular panelings P and then remove the screws 21 thereby detaching each paneling P from the wall with only screw holes, and a small number at that, remaining apparent on the wall (which can be easily repaired with plaster-types repair mixes).

FIG. 11 illustrates a wainscot made with a number of modular panelings P and with chair rail molding 34 and baseboard moldings 36 and 38. FIG. 12 shows a wall W with corners C and C' (and even a door D) wainscoted with the above-described components of the present invention.

If the wainscot does not end at door or at an inside corner, an additional component in the form of a vertical post or molding (not shown) is installed at the free vertical edge of the last modular panel P of the wainscot so as to provide a decorative finish thereto (and conceal the rib 12 or the groove 14 of the end strip 10), and this vertical molding may be mounted to the wall or to the end strip 10 with a pair of screws (or nails) installed at opposed upper and lower ends of the vertical molding.

The present modular paneling P can be pre-painted or pre-stained by the user, that is before being mounted to the wall thereby obviating the need to mask the floor and the wall. With the prior art strips which are mounted one-by-one to the wall and which are thus not interconnected together in a modular panel prior to installation to the wall, it is time consuming to paint or stain the strips one-by-one and they are thus often painted or stained after having been installed on the wall which requires masking of adjoining or adjacent surfaces.

The paneling P of the present invention is thus easy to install, to cut down to size and to ultimately remove. Furthermore, it does minimal damage to the wall as being attached thereto at a very limited number of distinct locations while being rigid enough to resist to warping in view of its structure. The components of the present invention, such a number of modular panels P sufficient to produce a given number of linear feet of wall covering or wainscoting, are typically sold in kit form, where the chair rails and baseboards may be sold separately from the modular panels P.

I claim:

1. An assembly for applying a decorative wooden covering onto a wall, comprising at least one wooden paneling made up of a series of elongated wooden strips disposed in a side-by-side and abutting relationship and being assembled together with connecting means, wall attachment means for securing said paneling to the wall, and molding means extending transversally across said wooden paneling such as to conceal said wall attachment means, wherein said paneling defines on a rear side thereof at least one channel extending across said strips, said connecting means comprising an elongated member received in said channel and detachably secured to said paneling for holding said strips together and made of a material capable of being cut, whereby said elongated member can be detached from said paneling thereby allowing for one or more of said strips to be removed therefrom and for said elongated member to be cut such that a width of said paneling can be reduced.

2. An assembly as defined in claim 1, wherein said molding means extend transversely across at least one of opposed ends of said paneling for concealing the same.

3. An assembly as defined in claim 2, wherein said wall attachment means comprise only non-adhesive fasteners adapted to be disposed at said opposed ends and to engage the wall thereby mounting said paneling to the wall, and wherein said molding means are adapted to be secured to said opposed ends while concealing said fasteners.

4. An assembly as defined in claim 3, wherein said fasteners comprise screws, and wherein nails are provide d for securing said molding means to said paneling.

5. An assembly as defined in claim 1, further comprising at least one elongated corner element adapted to be secured opposite a corner of the wall and between two adjacent, but non-coplanar, wooden panelings.

6. An assembly as defined in claim 5, wherein said corner element comprise two sections joined at an angle corresponding to that of the wall corner and being finished on both sides thereof, whereby said corner element is reversible.

7. An assembly as defined in claim 6, wherein said sections of said angle between said sections of said corner element is one of 45° and 90°.

8. An assembly as defined in claim 1, wherein there are at least two channels and two elongated members, each said elongated member being made of a wooden material.

9. An assembly as defined in claim 1, wherein staples secure said elongated member to said paneling.

10. A method of applying a wooden covering onto a wall, comprising the steps of:

a) providing a modular panel comprised of a series of elongated wooden strips disposed in a side-by-side and abutting relationship and joined together by detachable connecting means;

b) reducing a width of said modular panel by (1) detaching said detachable connecting means from said modular panel, (2) removing one or more said strips from said modular panel, and (3) attaching said detachable connecting means to said modular panel such as to retain said strips thereof together; and c) securing said modular panel to the wall, wherein in step c) said modular panel is secured to the wall with fastening means installed only at opposed ends of said modular panel, and further comprising after step c), installing molding means transversely across said opposed ends and securing said molding means to said opposed ends such as to conceal said fastening means.

11. A method as defined in claim 10, wherein in step c) said modular panel is mounted to the wall only with non-adhesive fastening means.

12. A method as defined in claim 10, wherein in step (3) said detachable connecting means are installed in channel means defined on a rear side of said modular panel.

13. A method as defined in claim 10, wherein the step of reducing the width of said modular panel is further effected by reducing a length of said detachable connecting means depending on the number of strips removed in (2).

* * * * *

UNITED STATES PATENT AND TRADEMARK OFFICE

CERTIFICATE OF CORRECTION

PATENT NO. : 5,894,701

DATED : April 20, 1999

INVENTOR(S) : Claude DELORME

It is certified that error appears in the above-identified patent and that said Letters Patent is hereby corrected as shown below:

On the title page,

Item [30] Foreign Application Priority is missing and should read:

--July 30, 1997 [CA] Canada 2,211,761--

Signed and Sealed this

Twenty-second Day of August, 2000

*Attest:*

Q. TODD DICKINSON

*Attesting Officer*

*Director of Patents and Trademarks*